United States Patent [19]

Isler

[11] Patent Number: 5,072,471

[45] Date of Patent: Dec. 17, 1991

[54] KNIFE WITH TWO WHEELS

[76] Inventor: Billy W. Isler, 4090 Bryan Blvd., Plantation, Fla. 33634

[21] Appl. No.: 623,117

[22] Filed: Dec. 6, 1990

[51] Int. Cl.[5] ..... B26B 11/00

[52] U.S. Cl. ..... 7/158; 81/488; 29/235

[58] Field of Search ..... 7/103, 105, 158; 81/488; 30/162, 335; 29/235

[56] References Cited

U.S. PATENT DOCUMENTS 494,516 3/1893 Walton ..... 7/105 X 4,910,821 3/1990 Kieferle ..... 81/488 X

*Primary Examiner*—James G. Smith

*Attorney, Agent, or Firm*—Alvin Blum

[57] ABSTRACT

A tool especially designed for a workman in a particular industry has an elongate handle with a retractable sliding knife blade at a first end. At a second end a pair of rotatable wheels are mounted. When constructed for screen installation, one of the wheels has a convex edge for forming the screen in the groove of the screen frame and the other wheel has a concave edge for firmly holding a locking spline and forcing it into the groove to lock the screen in place. Where constructed for the paperboard box fabricator, one of the wheels has piercing points for laying out a pattern (a pounce wheel) and the other wheel has a convex edge for pressing a folding groove into the paperboard. The tool makes it possible for the worker to perform three different tasks normally performed in sequence with a single, hand-held tool to speed up his work, the knife being for trimming off screen or paperboard as required.

7 Claims, 1 Drawing Sheet

KNIFE WITH TWO WHEELS

BACKGROUND OF THE INVENTION

This invention relates to hand-held, multiple use tools and more particularly to a tool having a retractable, sliding-blade knife at one end of a handle and a pair of special-purpose wheels rotatably mounted at a second end of the handle.

The installation of screening material into the frames of window and door screens and the like involves hand labor by screen installers. In most cases, the skilled screen installers use three hand tools respectively in sequence. A knife is used to cut the screen to a size larger than the opening. The cut piece of screen is laid over the frame, covering the opening. A wheel having a convex edge small enough to fit within the screen-holding groove in the frame, rotatably mounted on a handle is used to press the screen into the groove. A wheel having a concave edge adapted to fit over a resilient locking bead or spline is then used to force the spline into the groove over the screen to lock the screen in place on the frame, taut and wrinkle-free over the opening. This wheel is also rotatably mounted on handle. Considerable force must often be used to deform the spline to fit into the groove and pull the screen taut. Having a concave edge on the wheel helps to hold the spline in place while force is applied. A knife is then used to trim excess screen from beyond the groove.

Screen installing tools comprising a handle with a concave edge wheel rotatably mounted at one end of a handle and a convex wheel at another end are well known in the art. This structure requires the worker to turn the tool end for end if he uses the same stroke for both wheels. He must lay this tool aside and pick up a knife whenever he must cut the screen. This is awkward and time consuming.

U.S. Pat. No. 4,910,821 issued 3/27/90 to Kieferie discloses a screen installer's tool having a handle with a retractable sliding-blade knife at one end of a handle and a convex wheel rotatably mounted at another end. The installer must use the single wheel both for forcing the screen into the groove, for which it is well suited, and for forcing the locking bead or spline into the groove, for which it is not well suited, since it does not engage the spline as effectively as a concave edge. Greater skill and care is required of the worker. An indentation in the handle is required to enhance gripping during forceful pressure on the spline.

In the hand fabrication of cardboard and corrugated paperboard boxes, one ordinarily traces a pattern on the flat sheet material. The pattern includes the cut to be made along the outer perimeter and the lines along which folds are to be made. The cuts are made with a knife. The folds are effectively made by first running a rotary wheel with a convex edge along each line to indent the material to facilitate folding along the line. Tracing a pattern through a thin sheet material such as paper or plastic is easily done with a pounce wheel rotatably mounted on a handle. A pounce wheel is a disc with pin-wheel projections extending radially from the periphery of the disc. The pins go through the pattern, putting a row of pin holes in the sheet without cutting up the pattern so that it can be used many times. The box maker uses in sequence: the pounce wheel; the knife; and the convex edge wheel.

SUMMARY OF THE INVENTION

It is accordingly an object of the invention to provide for workers in the screen installing trade and the box making trade a hand held tool that combines a handle with a knife at one end and a pair of wheels, each having a special edge for special functions, rotatably mounted at a second end of the handle.

It is another object to provide the above tool with a knife having a retractable blade for safety.

It is yet another object to provide the above tool with means for effective gripping of the handle when applying force to a wheel.

it is yet another object to provide on wheel that has a convex edge and a second wheel that has a concave edge for screen installing purposes.

It is yet another object to provide one wheel that has pin elements extending radially from its periphery and a second wheel with a convex edge for box making purposes.

The tool of the invention comprises a handle having a retractible knife blade entending from a first end and a pair of wheels rotatably mounted on a second end and so arranged that the handle may be used to force the edge of either one of the wheels against a workpiece.

The invention may be constructed for use in the screen installing trade and the box making trade.

In both cases, a first wheel has a convex edge, while the second wheel differs for the two applications. For the screen installer's tool the second wheel has a concave edge for enhanced engagement of the spline. For the box maker's tool the second wheel has pin projections extending radially from the periphery for pattern tracing. Having a single, hand held tool that performs three different, related functions that are routinely performed in sequence speeds up the work, reduces labor costs, and saves over buying three separate tools.

These and other features, objects and advantages of the invention will become more apparent when the following detailed description is studied in conjunction with the drawings.

DETAILED DESCRIPTION OF PREFERRED EMBODIMENTS

Figures 1, 2, 3, 4:
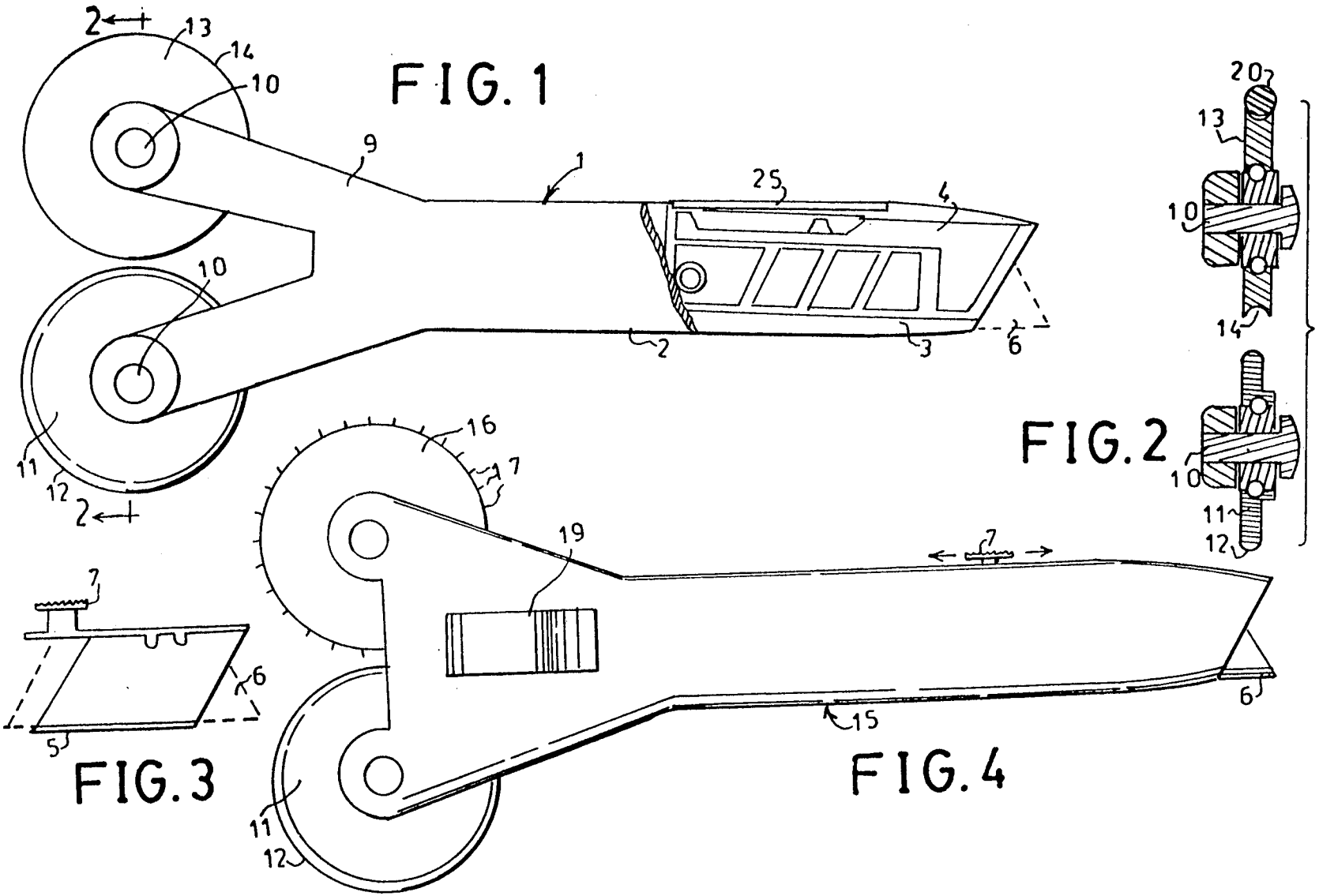
FIG. 1 is a side elevation of a screen installer tool of the invention with a portion broken away.
FIG. 2 is a sectional view taken through line 2—2 of FIG. 1.
FIG. 3 is a view of the blade carrier.
FIG. 4 is a side elevation view of a box maker tool of the invention.

Referring now first to FIGS. 1–3, a tool of the invention constructed for the screen installer is shown. The tool 1 includes a handle member 2, the right hand side 3 of which is a retractable sliding blade knife tool constructed in a manner well known in the art, with a hollow elongate internal compartment 4 which holds a slidable blade carrier 5 (FIG. 3) that holds a replaceable blade 6. A cover 25 provides access to compartment 4 for blade replacement. The blade carrier 5, operated by finger grip 7 slides the blade 6 between a retracted position entirely within the handle to an extended position for cutting the workpiece. When retracted, the worker can freely use the tool for other functions in safety. Extending from a second end 9 of the handle remote from the knife end, the handle expands into a support for two axles 10. One axle rotatably supports a first wheel 11 having a convex edge 12. This wheel is used to force the screen into the groove in the frame. A second wheel 13 has a concave edge 14. This wheel is adapted for engaging the resilient bead or spline 20 that is forced into the groove in the frame over the screen to lock the screen tightly in place. Because considerable force must be applied, the hand tends to slide down the handle on conventional tools. This may require gripping the handle tightly which is tiring. The enlargement of the handle at the support end 9 overcomes this problem, providing a comfortable stop for the hand. After the screen is locked in place by the spline, the knife blade is extended and the excess screen extending beyond the spline is cut off.

FIG. 4 shows a tool 15 of the invention constructed for box makers. The handle 2, knife 6, axle support 9, axles 10 and convex wheel 11 are the same. The second wheel 16 is a pounce wheel with pin members 17 extending radially from the edge. It is used to trace patterns, the pins extending through the overlying pattern and into the paperboard or cardboard workpiece producing a series of dotted lines in appearance. These may be edges to be cut by the knife blade 6 or lines along which the board is to be folded. By forcefully running the wheel 11 along these lines, grooves are impressed into the board so that the board can be readily folded along those lines to form the box.

A spring belt or pocket clip 19 may be provided for convenience in carrying the tool when not is use.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A triple function hand tool comprising:

A) an elongate handle member having a long axis, adapted to be held and operated by one hand, and containing a hollow elongate internal compartment;

B) a cover member removably attached to said handle member for providing access to said compartment;

C) a blade carrier means for carrying a knife blade slidably within said compartment and for retractably extending said blade from a first end of said long axis of said handle member to provide for cutting a workpiece in a first function;

D) supporting means supporting two axles, said supporting means connected to a second end of said long axis of said handle member;

E) a first wheel rotatably mounted on a first one of said axles, said first wheel having a substantially convex edge for forcefully impressing a workpiece in a second function; and F) a second wheel rotatably mounted on a second one of said axles, said second wheel having a non-convex edge adapted for application to a workpiece in a third function.

2. The tool according to claim 1 arranged for screen installation, in which said second wheel has a substantially concave edge for engaging locking spline elements.

3. The tool according to claim 1 arranged for box making, in which said second wheel has an edge with a plurality of radially extending piercing elements extending therefrom.

4. A tool for installing screen in a screen frame comprising:

A) a two-ended tool body adapted to be held in one hand and containing a hollow, elongated internal compartment, said tool body having a long axis with one end at each end of said long axis;

B) a slidable knife blade carrier arranged for slidable movement of said carrier and a knife blade within said compartment and for retractably extending a portion of said blade beyond a first end of said tool body for cutting said screen;

C) a wheel support means connected to a second end of said tool body for rotatably supporting a pair of wheels;

D) a screen forming wheel rotatably mounted on said wheel support means, said screen forming wheel having a substantially convex edge for forming said screen in a groove in said screen frame; and E) a spline engaging wheel rotatably mounted on said wheel support means, said spline engaging wheel having a substantially concave edge for engaging a spline element and forcing it into said groove to lock said screen in place.

5. The tool according to claim 4, in which said wheel support means has a greater transverse dimension than the transverse dimension of said tool body for enhanced gripping while applying force to one of said wheels.

6. A tool for making boxes of sheet material from the group including cardboard, paperboard and corrugated paperboard comprising:

A) a two-ended tool body adapted to be held in one hand and containing a hollow, elongated internal compartment, said tool body having a long axis with an end at each end of said long axis;

B) a slidable knife blade carrier arranged for slidable movement of said carrier and a knife blade within said compartment and for retractably extending a portion of said blade beyond a first end of said tool body for cutting said sheet material;

C) a wheel support means connected to a second end of said tool body for rotatably supporting a pair of wheels;

D) a piercing wheel rotatably mounted on said wheel support means, said piercing wheel having a plurality of piercing elements extending radially therefrom for piercing a pattern on said sheet material; and E) a second wheel, rotatably mounted on said wheel support means, said second wheel having a periphery arranged for forcefully impressing folding grooves into said sheet material for folding into a box.

7. The tool according to claim 6, in which said wheel support means has a greater transverse dimension than said tool body for enhanced gripping while applying force to one of said wheels.

* * * * *